US008525089B2

(12) United States Patent
Shin et al.

(10) Patent No.: US 8,525,089 B2
(45) Date of Patent: Sep. 3, 2013

(54) WING DEVICE AND FLIGHT VEHICLE HAVING THE SAME

(75) Inventors: Sang-Hun Shin, Daejeon (KR); Hae-Yong Jeong, Gyeongsangnam-Do (KR)

(73) Assignee: Agency For Defense Development, Daejeon (KR)

( * ) Notice: Subject to any disclaimer, the term of this patent is extended or adjusted under 35 U.S.C. 154(b) by 161 days.

(21) Appl. No.: 13/084,434

(22) Filed: Apr. 11, 2011

(65) Prior Publication Data

US 2011/0315812 A1 Dec. 29, 2011

(30) Foreign Application Priority Data

Jun. 25, 2010 (KR) ..... 10-2010-0060830

(51) Int. Cl.
*F42B 15/01* (2006.01)
*B64C 3/56* (2006.01)

(52) U.S. Cl.
USPC ..... 244/3.24; 244/49; 244/3.27; 244/3.28

(58) Field of Classification Search
USPC ..... 244/3.24, 3.26, 3.28, 3.29, 3.27, 244/49
See application file for complete search history.

(56) References Cited

U.S. PATENT DOCUMENTS 2,793,591 A * 5/1957 Jasse ..... 244/3.29
2,858,765 A * 11/1958 Startzell ..... 244/3.29
2,924,175 A * 2/1960 Jasse ..... 244/3.29
3,451,646 A * 6/1969 Aarnaes ..... 244/46
3,588,004 A 6/1971 Suter
3,853,288 A 12/1974 Bode
3,952,970 A * 4/1976 Orzechowski et al. ..... 244/3.23
3,964,696 A * 6/1976 Orzechowski et al. ..... 244/3.23
4,213,587 A * 7/1980 Roeseler et al. ..... 244/213
4,232,843 A * 11/1980 Clark et al. ..... 244/3.29
4,588,145 A * 5/1986 Inglis ..... 244/3.24
4,673,146 A * 6/1987 Inglis ..... 244/3.23
6,739,548 B1 5/2004 Bittle

OTHER PUBLICATIONS

Korean Office Action dated Jun. 22, 2012, Korean Patent Application No. 10-2010-0060830.

* cited by examiner

*Primary Examiner* — Philip J Bonzell
(74) *Attorney, Agent, or Firm* — Vierra Magen Marcus LLP

(57) ABSTRACT

Disclosed are a wing device for a flight vehicle and a flight vehicle having the same, the wing device including a fixing shaft disposed in a lengthwise direction of a main body of the flight vehicle, a wing rotatably mounted to the fixing shaft so as to be deployed from a state of being laid on an outer circumferential surface of the main body to an erected state, and slidable along the fixing shaft, a fixing groove formed to face the wing in a sliding direction of the wing, and a spring unit configured to apply a first elastic force in an outer circumferential direction of the main body for deployment of the wing, and apply a second elastic force in a lengthwise direction of the main body for inserting the wing into the fixing groove, whereby the wing can be fixed after deployment so as to enhance stability of the flight vehicle.

13 Claims, 4 Drawing Sheets

WING DEVICE AND FLIGHT VEHICLE HAVING THE SAME

CROSS-REFERENCE TO RELATED APPLICATION

Pursuant to 35 U.S.C. §119(a), this application claims the benefit of earlier filing date and right of priority to Korean Application No. 10-2010-0060830, filed on Jun. 25, 2010, the contents of which is incorporated by reference herein in its entirety.

BACKGROUND OF THE INVENTION

1. Field of the Invention

The present invention relates to a wing device for a flight vehicle whose wing deploys responsive to launching, and a flight vehicle having the same.

2. Background of the Invention

A flight vehicle (flying object, aerial vehicle) is provided with wings for a stable flight. Especially, for guided missiles or the like, wings may be configured to be folded within a launching tube and then deployed out of a fuselage at an appropriate flying time after being slid out of the launching tube.

Such foldable wings are typically designed in a shape of a curved surface in correspondence with an outer appearance of a flight vehicle for minimization of their installation space. However, the wings having the curved surfaces may cause a rotational motion due to a difference of a pneumatic force applied to both surfaces of each wing during flight, thereby lowering stability of the flight vehicle. Furthermore, since each wing is typically supported only by a force of a deployment spring, the wing is not completely fixed after deployment and thereby a clearance problem is caused between the wing and a main body of the flight vehicle. Since such clearance lowers the stability of flight, a problem may be caused that the structure of the wing is difficult to be applied to flight vehicles, which need to be accurately guided.

Consequently, a wing device which is capable of further improving the stability of a flight vehicle may be considered.

SUMMARY OF THE INVENTION

Therefore, an object of the present invention is to provide a wing device capable of completely fixing wings after deployment, and a flight vehicle having the same.

Another object of the present invention is to provide a wing device capable of providing high stability of a flight vehicle even with a simplified structure.

To achieve these and other advantages and in accordance with the purpose of the present invention, as embodied and broadly described herein, there is provided a wing device for a flight vehicle including a fixing shaft disposed in a lengthwise direction of a main body of the flight vehicle, a wing rotatably mounted to the fixing shaft so as to be deployed from a state of being laid on an outer circumferential surface of the main body to an erected state, and slidable along the fixing shaft, a fixing groove formed to face the wing in a sliding direction of the wing, and a spring unit configured to apply a first elastic force in an outer circumferential direction of the main body for deployment of the wing, and apply a second elastic force in a lengthwise direction of the main body for inserting the wing into the fixing groove.

In one aspect of the present invention, the spring unit may be wound on the fixing shaft in the outer circumferential direction of the main body to generate the first and second elastic forces. The spring unit may include a main body portion, a fixed portion and an extension portion. The main body portion may extend with being wound on the fixing shaft and have one end supported by the wing to generate the second elastic force. The fixed portion may be formed at another end of the main body portion to be fixed to the main body. The extension portion may extend from one end of the main body portion in an intersecting direction with the fixing shaft to generate the first elastic force and be supported by the wing in the outer circumferential direction. The first elastic force may be a torsional restoring force generated as the wing is laid, and the second elastic force may be a compressive restoring force generated in response to the sliding of the wing.

In another aspect of the present invention, a peripheral groove may be formed at the main body in the outer circumferential direction thereof so as to accommodate therein the wing in the laid state. The fixing groove may be recessed into a side surface of the peripheral groove in the lengthwise direction, and a fixing hole for inserting the fixing shaft therein may be formed at the fixing groove. The spring unit may be coupled to the peripheral groove, and a fixing ring may be formed to be wound on the peripheral groove. One side of the wing may be inclined with respect to a side surface of the peripheral groove or a lubrication member may be mounted onto the side surface of the peripheral groove, in order to reduce a friction generated during deployment of the wing.

In another aspect of the present invention, the wing may include an upper end portion, a lower end portion and an accommodation chamber. The upper end portion may form a free end rotating based upon the fixing shaft, and the lower end portion may have a through hole for inserting the fixing shaft therethrough such that the wing is rotatably coupled to the main body. The accommodation chamber may be formed at the lower end portion for accommodating the spring unit therein. The wing may be formed such that the upper end portion and the lower end portion are connected in a linear form.

In one aspect of the present invention, there is provided a flight vehicle including a main body of the flight vehicle, a fixing shaft disposed in a lengthwise direction of the main body, a wing rotatably mounted to the fixing shaft so as to be deployed from a state of being laid on an outer circumferential surface of the main body to an erected state, and slidable along the fixing shaft, a fixing groove formed to face the wing in a sliding direction of the wing, and a spring unit configured to apply a first elastic force in an outer circumferential direction of the main body for deployment of the wing, and apply a second elastic force in a lengthwise direction of the main body for inserting the wing into the fixing groove. The wing may be pressed by an inner wall of a launching tube in the laid state if the main body is disposed within the launching tube.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
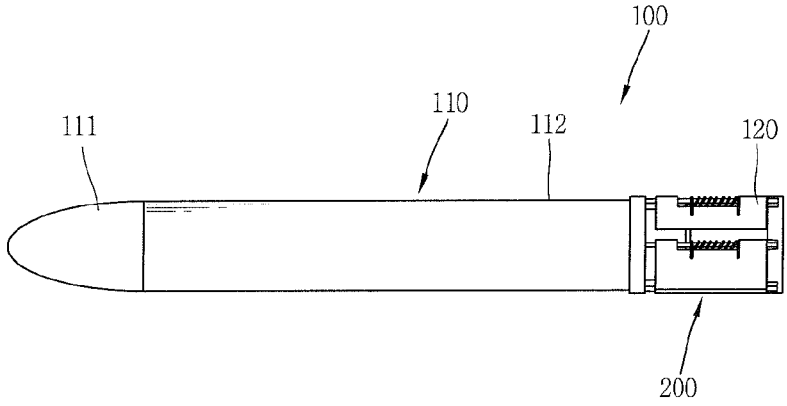
FIG. 1 is an overview of a flight vehicle in accordance with one embodiment of the present invention.

Description will now be given in detail of the preferred embodiments according to the present invention, with reference to the accompanying drawings. This specification employs like/similar reference numerals for like/similar components irrespective of different embodiments, so they all will be understood by the first description. The expression in the singular form in this specification will cover the expression in the plural form unless otherwise indicated obviously from the context.

Figure 2A:
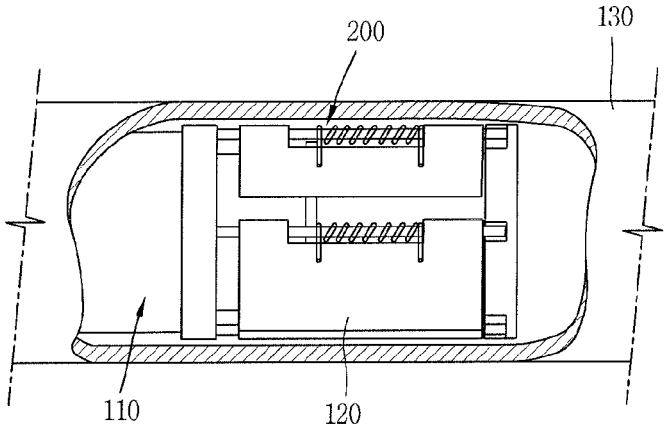
FIGS. 2A and 2B are a front view and a sectional view, respectively, showing an accommodated state of the flight vehicle of FIG. 1 in a launching tube.
Figure 2B:
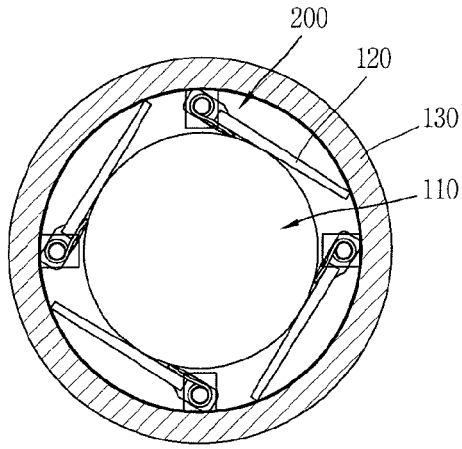

FIG. 1 is an overview of a flight vehicle in accordance with one embodiment of the present invention, and FIGS. 2A and 2B are a front view and a sectional view, respectively, showing an accommodated state of the flight vehicle of FIG. 1 in a launching tube.

FIG. 1 shows a guided missile as an example of a flight vehicle 100, and as shown, the flight vehicle 100 may include a main body 110 and wings 120.

The main body 110 may be formed to be flied by virtue of a propulsive force, and include a front end section 111 and a rear end section 112.

The front end section 111 may be formed at a front end with respect to a proceeding direction of the main body 110, and configured in a streamline form. The rear end section 112 may be formed at an opposite side to the front end section 111. The wings 120 may be disposed at the rear end section 112 to urge the main body 110 proceed in one direction. The wings 120 may be provided in plurality so as to be disposed at a preset interval along a circumference of the main body 110. The wings 120 may allow the flight vehicle 100 to keep flying straight ahead in a stable state. However, the present invention may not be limited to the structure. Alternatively, the wings 120 may be disposed at the front end section 111 or between the front end section 111 and the rear end section 112.

Referring to FIGS. 2A and 2B, the wings 120 may be disposed within a launching tube 130 in a state of being laid on an outer circumferential surface of the main body 110. Accordingly, the diameter of the launching tube 130 may be further reduced, and also the rear end section of the main body 110 may be guided along an inner wall of the launching tube 130 upon launching of the flight vehicle 100.

Upon launching of the flight vehicle 100, the wings 120 may be deployed, by virtue of a wing device 200, from the laid state (hereinafter, referred to as "folded state" of the wing) on the outer circumferential surface of the main body 110 to an erected state (hereinafter, referred to as "unfolded state" of the wing). Hereinafter, the wing device 200 of FIG. 1 will be described in more detail with reference to FIG. 3 and FIGS. 4A to 4C.

Figure 3:
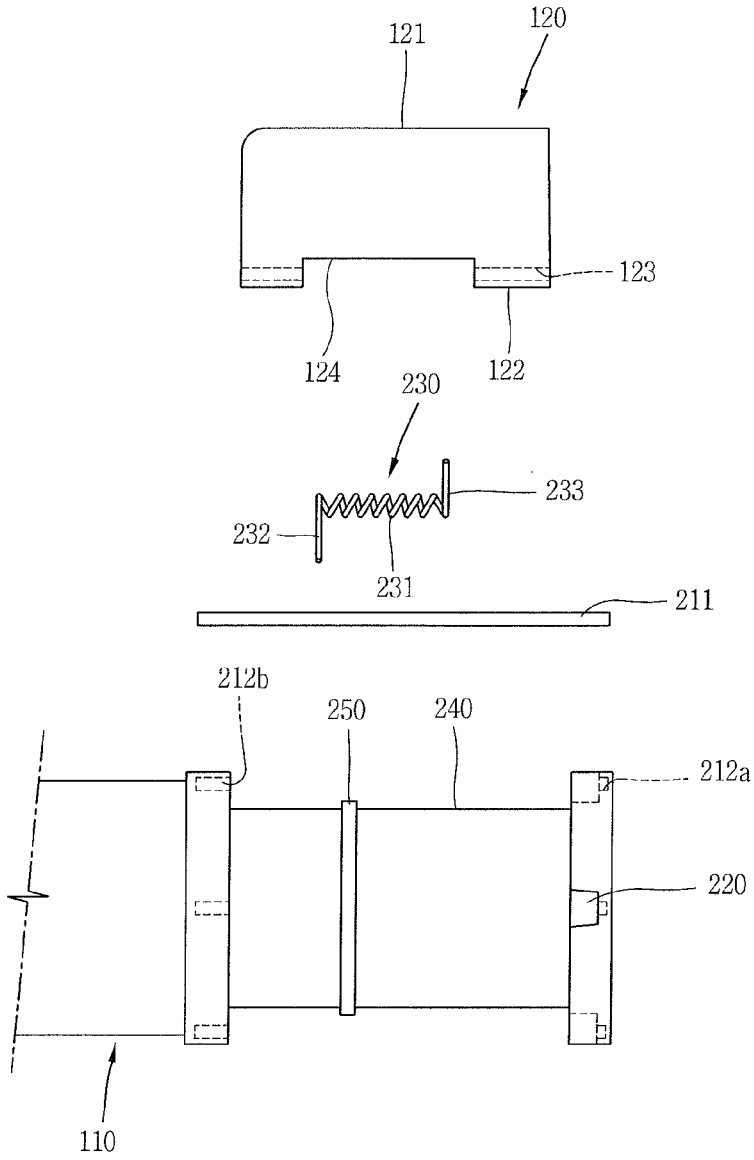
FIG. 3 is a disassembled view of a wing device shown in FIG. 1.

FIG. 3 is a disassembled view of the wing device 200 of FIG. 1, and FIGS. 4A to 4C are operational views respectively showing a folded state, an unfolded state and a fixed state of the wings 120.

Referring to FIG. 3, the wing device 200 of the flight vehicle may include a fixing shaft 211, a fixing groove 220 and a spring unit 230, as well as the wing 120.

The fixing shaft 211 may be disposed in a lengthwise direction of the main body 110, and the wing 120 may be rotatably coupled to the corresponding fixing shaft 211. For instance, a lower end portion 122 of the wing 120 is coupled to the fixing shaft 211 by a hinge, and an upper end portion 121 of the wing 120 may rotate toward an outer circumference of the main body 110 so as to implement the folded state and the unfolded state of the wing 120. That is, the upper end portion 121 of the wing 120 may act as a free end, which is rotatable centering around the fixing shaft 211.

The main body 110 of the flight vehicle 100 may include a peripheral groove 240 formed along the outer circumferential direction of the main body 110 for accommodating the wings 120 therein in the folded state. The lower end portion 122 of each wing 120 may be accommodated in the peripheral groove 240. The fixing shaft 211 may be mounted to fixing holes 212*a* and 212*b*, formed at the main body 110, through the lower end portion 122 of the corresponding wing 120. The fixing holes 212*a* and 212*b* may be formed in pair, so as to be present to face each other.

As shown, each wing 120 may be formed to be slidable in the lengthwise direction of the main body 110 along the fixing shaft 211. A through hole 123 through which the fixing shaft 211 is inserted may be formed through the lower end portion 122 of each wing 120. As the through hole 123 is guided by the fixing shaft 211 such that the wing 120 can move along the fixing shaft 211.

The fixing groove 220 may be formed to face the wing 120 in a sliding direction of the wing 120. The fixing groove 220 may be recessed into a side surface of the peripheral groove 240 in the lengthwise direction of the main body 110 such that at least part of the wing 120 is inserted therein. One (e.g., 212*b*) of the fixing holes 212*a* and 212*b* facing each other may be formed at one side of the fixing groove 220.

The spring unit 230 may apply a first elastic force in an outer circumference of the main body 110 such that the wing 120 can be deployed, and apply a second elastic force in the lengthwise direction of the main body 110 such that the wing 120 can be inserted in the fixing groove 220.

At least part of the spring unit 230 may be wound on the fixing shaft 211 in an outer circumferential direction of the main body 110 so as to generate the first and second elastic forces. The first elastic force may be a torsional restoring force, which is generated as the wing 120 is folded, and the second elastic force may be a compressive restoring force, which is generated as the wing 120 is slid. Such forces may be implemented by the shape of the spring unit and a coupling mechanism thereof.

Referring to FIG. 3, the spring unit 230 may include a body portion 231, a fixed portion 232 and an extension portion 233.

The body portion 231 may be configured as a coil which extends in a lengthwise direction of the fixing shaft 211 with being wound on the fixing shaft 211. The body portion 231 may have one end supported by the wing 120 so as to generate the torsional restoring force. In more detail, the lower end portion 122 of the wing 120 is shown, having an accommodation chamber 124 for accommodating the spring unit 230 therein, and a lengthwise end portion of the body portion 231 may support one side of the accommodation chamber 124.

The accommodation chamber 124 may be formed, for example, by cutting off at least part of the central area of the lower end portion 122.

The fixed portion 232 may be formed at another end of the body portion 231, and fixed to the main body 110 of the flight vehicle. A fixing ring 250 formed to be wound on the peripheral groove 240 may be mounted onto the peripheral groove 240 so as to allow coupling of the spring unit 230. As the fixed portion 232 is inserted into the fixing ring 250, the spring unit 230 can be secured with the main body 110 of the flight vehicle. Here, the present invention may not be limited to the structure. Alternatively, a coupling hole to which the fixed portion 232 is coupled may be formed, for example, at a bottom of the peripheral groove 240.

The extension portion 233 may extend in an intersecting direction with the fixing shaft 211 from one end of the body portion 231 so as to generate the first elastic force, and supported by the wing 120 in an outer circumferential direction of the main body 110. As the extension portion 233 projects from an outer circumference of the coil, when the wing 120 rotates in a direction to be folded, the wing 120 may apply a force to the extension portion 233 in a direction of the coil being wound or vice versa. Such mechanism may allow the spring unit 230 to act as a torsion spring with respect to the wing 120 in the outer circumferential direction of the main body 110.

Figure 4A:
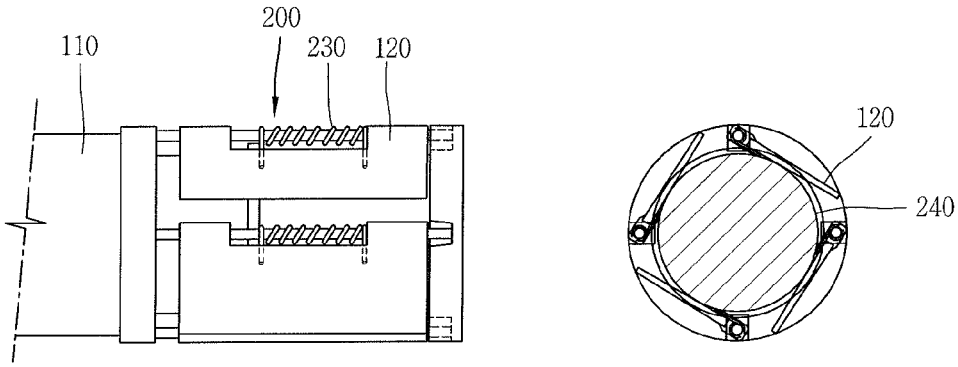
FIGS. 4A to 4C are operational views respectively showing a folded state, an unfolded state and a fixed state of the wing.

Referring to FIG. 4A, the wings 120 are restricted in the folded state. The restriction may be implemented by but not limited to the inner wall of the launching tube (see 130 of FIG. 2A). Alternatively, a restriction device may separately be provided in the flight vehicle 100 or the launching tube 130. In the folded state, a torsional force (twisting force, torque) or a compressive force may be applied to the spring unit 230. Upon launching of the flight vehicle 100, referring to FIG. 4B, the wing 120 may rotate to the unfolded state by virtue of the torsional restoring force of the spring unit 230.

Figure 4B:
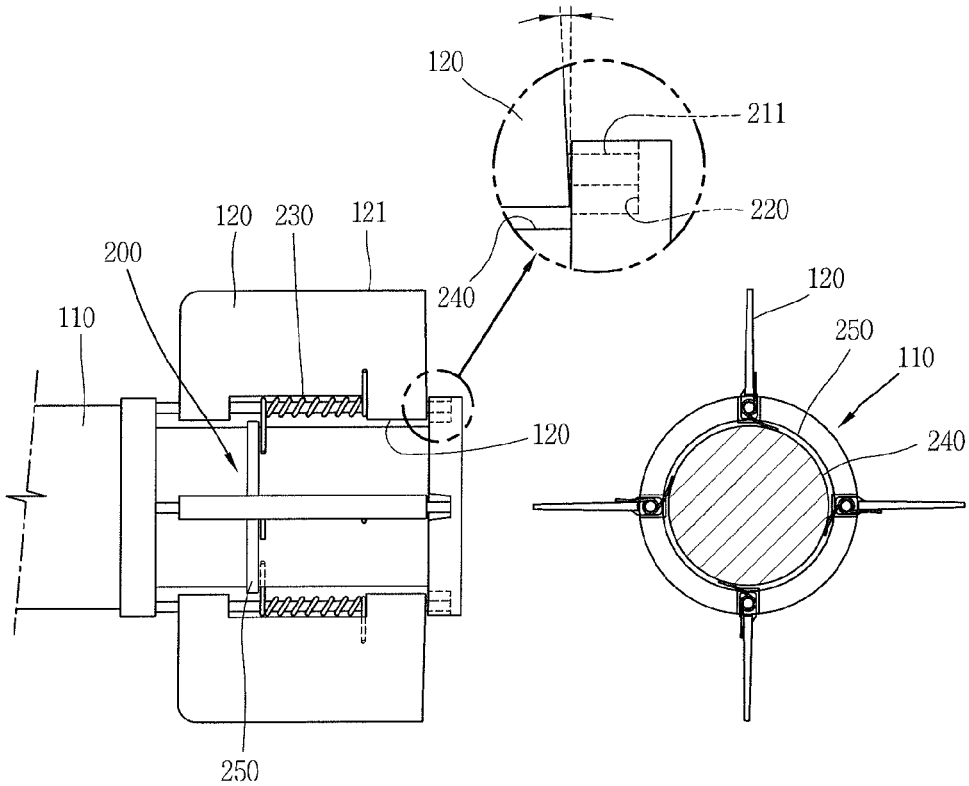
Figure 4C:
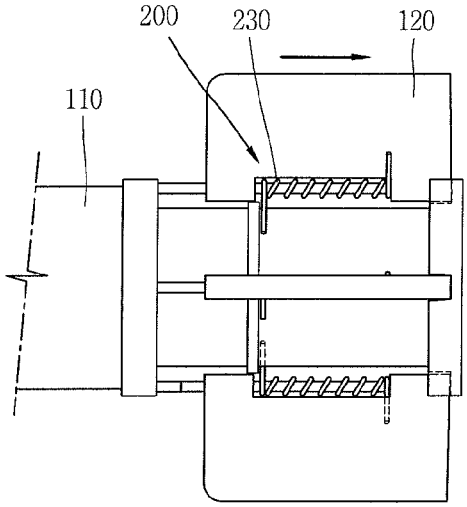

When the wing 120 is unfolded, referring to FIG. 4C, the wing 120 is slid along the fixing shaft 211 responsive to the compressive restoring force of the spring unit 230, accordingly, one side of the wing 120 is inserted into the fixing groove 220. The fixing groove 220 may be formed to have an inclined side surface such that the width thereof can be narrowed in the direction that the wing 120 is slid. Consequently, the wing 120 can be inserted into the fixing groove 220.

Hence, as the wing device 200 urges the wings 120 rotated and slid, the wings 120 may be fixed firmly in the unfolded state with coming out of the launching tube 130.

Referring to FIGS. 3 and 4A, the wing 120 may be configured such that its upper end portion 121 and the lower end portion 122 may be connected in a linear form. Owing to the linear form of the wing 120, an unbalance of a pneumatic force due to the shape of the wing 120 may not be caused during flight of the flight vehicle 100. Also, the wing 120 may be formed to externally come in contact with the peripheral groove 240 between the upper end portion 121 and the lower end portion 122, thereby minimizing the interference with the launching tube 130 (see 130 of FIG. 2A) upon being assembled to the launching tube 130.

Referring to FIGS. 3 and 4B, in order to alleviate a friction during deployment of the wing 120, one side of the wing 120 may be formed to be inclined with respect to the side surface of the peripheral groove 240. In more detail, the deployment of the wing 120 is executed with the rear edge of the wing 120 coming in contact with the side surface of the peripheral groove 240. Therefore, to reduce the friction therebetween during the deployment, a string of the lower end portion 122 may be formed to be longer than the string of the upper end portion 121.

Figure 5:
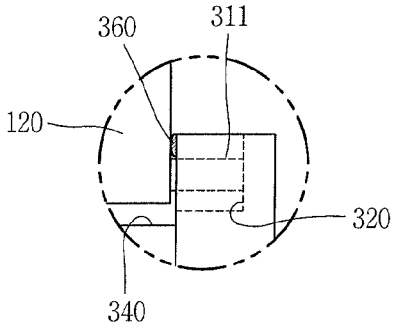
FIG. 5 is an enlarged view showing a variation of a wing device according to the present invention.

FIG. 5 is an enlarged view showing a variation of a wing device according to the present invention. Hereinafter, the description of the like/similar configurations to the embodiment illustrated with reference to FIG. 4B will be understood by the first description.

Referring to FIG. 5, a lubrication member 360 may be disposed at a side surface of a peripheral groove 340. The lubrication member 360 may be configured to cover a side surface of the peripheral groove 340, which is contacted by a rear edge of the wing 120. The lubrication member 360, for example, may be coated on the side surface of the peripheral groove 340 in a friction reducing coating manner, such as processing with a solid fluid film layer. Accordingly, the friction caused during deployment of the wing 120 can be further reduced, and a fast deployment and fixing of the wing can be achieved.

With the configurations of the wing device and the flight vehicle having the same, the spring unit allows the wing to be rotated and slid, which results in implementation of a more simplified wing deployment and fixing mechanism. Therefore, the wing device can be facilitated to be mounted in the main body of the flight vehicle. Also, any separate component is not needed due to the simplified structure, thereby providing the effects of reduction of volume and weight of the flight vehicle.

In addition, the wing can be deployed and simultaneously fixed owing to the employment of the spring unit and the fixing groove, accordingly, a clearance generated during fixing of the wing can be minimized and the wing can be firmly fixed to the main body. The firm fixing of the wing can improve stability and control of the flight vehicle. Therefore, the wing device can be applied to flight vehicles, such as guide missiles, which are to be accurately guided, as well as flight vehicles, such unguided rockets.

Furthermore, the wing may be formed in a linear form so as to minimize the unbalance of a pneumatic force caused due to the shape of the wing and to implement a linear wing, which is foldable in a minimized space within a launching tube through a peripheral groove.

The configurations and methods of the wing device of the flight vehicle and the flight vehicle having the same in the aforesaid embodiments may not be limitedly applied, but such embodiments may be configured by a selective combination of all or part of each embodiment so as to derive many variations.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A wing device for a flight vehicle comprising:

a fixing shaft disposed in a lengthwise direction of a main body of the flight vehicle;

a wing rotatably mounted to the fixing shaft so as to be deployed from a state of being laid on an outer circumferential surface of the main body to an erected state, and slidable along the fixing shaft;

a fixing groove formed to face the wing in a sliding direction of the wing; and a spring unit configured to apply a first elastic force in an outer circumferential direction of the main body for deployment of the wing, and apply a second elastic force in a lengthwise direction of the main body for inserting the wing into the fixing groove in response to the sliding of the wing after the deployment of the wing, wherein a peripheral groove is formed at the main body in the outer circumferential direction thereof so as to accommodate therein the wing in the laid state, wherein a lubrication member is mounted onto a side surface of the peripheral groove in order to reduce a friction generated during deployment of the wing, and wherein the lubrication member is configured to cover the side surface of the peripheral groove, which is contacted by the wing.

2. The device of claim 1, wherein the first elastic force is a torsional restoring force generated as the wing is laid, and the second elastic force is a compressive restoring force generated in response to the sliding of the wing.

3. The device of claim 1, wherein the fixing groove is recessed into a side surface of the peripheral groove in the lengthwise direction, and a fixing hole for inserting the fixing shaft therein is formed at the fixing groove.

4. The device of claim 1, wherein the spring unit is coupled to the peripheral groove, and a fixing ring is formed to be wound on the peripheral groove.

5. The device of claim 1, wherein the spring unit is wound on the fixing shaft in the outer circumferential direction of the main body to generate the first and second elastic forces.

6. The device of claim 5, wherein the spring unit comprises:

a main body portion extending with being wound on the fixing shaft and having one end supported by the wing to generate the second elastic force;

a fixed portion formed at another end of the main body portion and fixed to the main body; and an extension portion extending from one end of the main body portion in an intersecting direction with the fixing shaft to generate the first elastic force and supported by the wing in the outer circumferential direction.

7. The device of claim 1, wherein the wing comprises:

an upper end portion forming a free end rotating based upon the fixing shaft;

a lower end portion having a through hole for inserting the fixing shaft therethrough such that the wing is rotatably coupled to the main body; and an accommodation chamber formed at the lower end portion for accommodating the spring unit therein.

8. The device of claim 7, wherein the wing is formed such that the upper end portion and the lower end portion are connected in a linear form.

9. A flight vehicle comprising:

a main body of the flight vehicle;

a fixing shaft disposed in a lengthwise direction of the main body;

a wing rotatably mounted to the fixing shaft so as to be deployed from a state of being laid on an outer circumferential surface of the main body to an erected state, and slidable along the fixing shaft;

a fixing groove formed to face the wing in a sliding direction of the wing; and a spring unit configured to apply a first elastic force in an outer circumferential direction of the main body for deployment of the wing, and apply a second elastic force in a lengthwise direction of the main body for inserting the wing into the fixing groove in response to the sliding of the wing after the deployment of the wing, wherein a peripheral groove is formed at the main body in the outer circumferential direction thereof so as to accommodate therein the wing in the laid state, wherein a lubrication member is mounted onto a side surface of the peripheral groove in order to reduce a friction generated during deployment of the wing, and wherein the lubrication member is configured to cover the side surface of the peripheral groove, which is contacted by the wing.

10. The vehicle of claim 9, wherein the first elastic force is a torsional restoring force generated as the wing is laid, and the second elastic force is a compressive restoring force generated in response to the sliding of the wing.

11. The vehicle of claim 9, wherein the fixing groove is recessed into a side surface of the peripheral groove in the lengthwise direction, and a fixing hole for inserting the fixing shaft therein is formed at the fixing groove.

12. The vehicle of claim 9, wherein the spring unit is wound on the fixing shaft in the outer circumferential direction of the main body to generate the first and second elastic forces.

13. The vehicle of claim 12, wherein the spring unit comprises:

a main body portion extending with being wound on the fixing shaft and having one end supported by the wing to generate the second elastic force;

a fixed portion formed at another end of the main body portion and fixed to the main body; and an extension portion extending from one end of the main body portion in an intersecting direction with the fixing shaft to generate the first elastic force and supported by the wing in the outer circumferential direction.

* * * * *